United States Patent [19]

Gesing et al.

[11] Patent Number: 4,737,254

[45] Date of Patent: Apr. 12, 1988

[54] LININGS FOR ALUMINIUM REDUCTION CELLS

[75] Inventors: Adam J. Gesing; David N. Mitchell; Douglas N. Reesor, all of Kingston, Canada

[73] Assignee: Alcan International Limited, Montreal, Canada

[21] Appl. No.: 901,426

[22] Filed: Aug. 28, 1986

[30] Foreign Application Priority Data

Sep. 6, 1985 [GB] United Kingdom ..... 8522138

[51] Int. Cl.[4] ..... C25C 3/08

[52] U.S. Cl. ..... 204/243 R; 204/291

[58] Field of Search ..... 204/67, 243 R–247, 204/291

[56] References Cited

U.S. PATENT DOCUMENTS 4,033,836 7/1977 Holmes ..... 204/243 R X
4,383,910 5/1983 Richards ..... 204/243 R
4,548,692 10/1985 Scharpey ..... 204/243 R
4,560,448 12/1985 Sane et al. ..... 204/67
4,647,357 3/1987 Dewing ..... 204/291 X

FOREIGN PATENT DOCUMENTS 0092525 10/1983 European Pat. Off. ..... 204/243 R

*Primary Examiner*—Donald R. Valentine
*Attorney, Agent, or Firm*—Cooper & Dunham

[57] ABSTRACT

A lining to support the liquid contents of an aluminium electrolytic reduction cell includes an upper layer which is penetrated by electrolyte during operation of the cell, consisting essentially of unbonded alumina, including a substantially close-packed array of alumina shapes, the gaps between the shapes being substantially filled with particulate alumina in one or more fractions having discrete particle size ranges, including a fraction having an average particle diameter not more than 20% of the average diameter of the shapes, the layer having a bulk density of at least 2.0 g/cc.

10 Claims, 1 Drawing Sheet

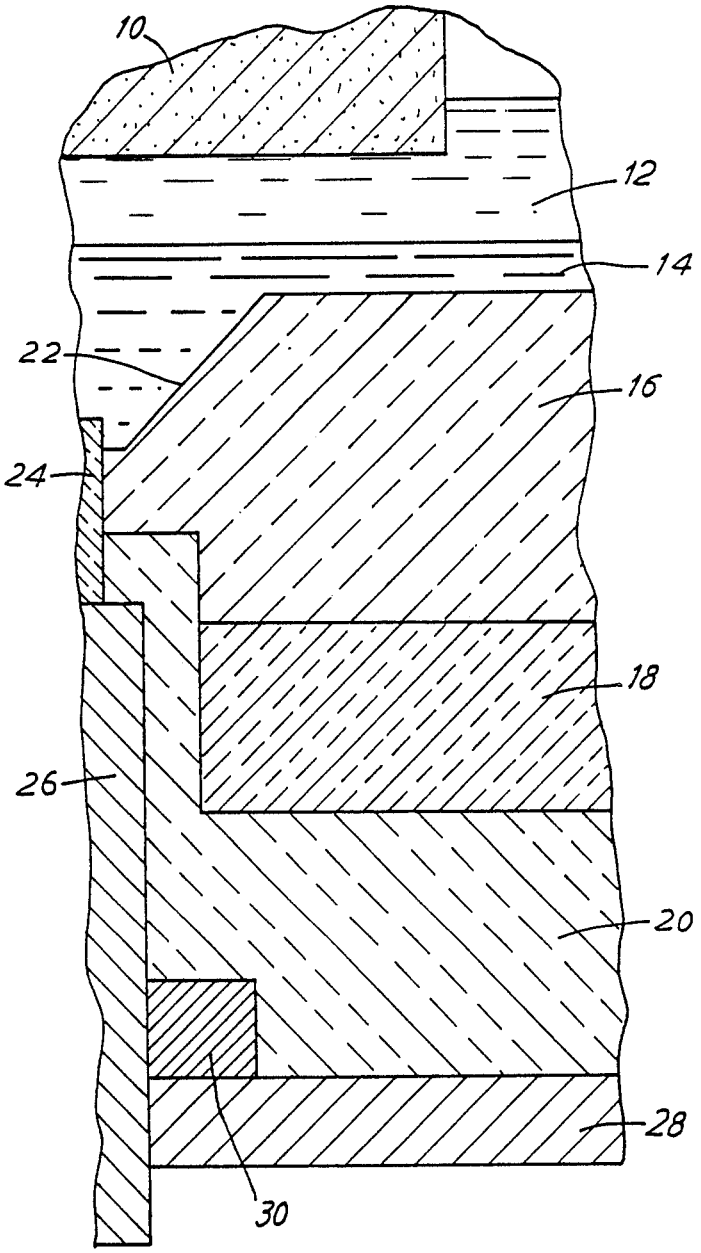
10
12
14
22
16
24
18
26
20
28
30

LININGS FOR ALUMINIUM REDUCTION CELLS

A conventional aluminium reduction cell uses a bath of cryolite-based electrolyte containing dissolved alumina. Carbonaceous anodes dip into the bath from above and are progressively consumed. The cell floor may be made up of carbonaceous blocks bonded together with carbonaceous cement, or may be formed using a rammed mixture of carbonaceous material and pitch. Below the floor is a layer of insulating material, typically alumina, which itself rests on a steel slab forming part of the shell. As electrolysis proceeds, a layer of molten product aluminium is built up on the floor of the cell, from where it is tapped from time to time. The layer or "pad" of molten metal constitutes, together with the carbonaceous floor, the cathode of the cell.

The carbonaceous floor is to some extent reactive with the electrolyte and needs to be protected by the molten metal pad. The metal does not wet the carbon and the pad therefore has to be maintained at substantial thickness. Strong magnetic forces associated with such cells interact with horizontal electrical currents in the carbonaceous floor to give rise to magnetohydrodynamic (MHD) effects which cause instability of the molten metal pad and are not desired. Further, carbonaceous floors are quite expensive to build and expensive on materials.

Over the years there have been a number of proposals to replace the electrically conducting carbonaceous cell floor with a lining of cheaper electrically insulating material. Cathode current collectors are required, to withdraw current from the molten metal pad, and these can extend vertically down through the floor so as to minimise the undesired horizontal electrical currents. As materials for cathode current collectors, electrically conducting refractory hard metals (RHM), particularly titanium diboride, have proved suitable.

Dewey (U.S. Pat. No. 3,093,570) teaches the use as a cell lining material of a cryolite/alumina aggregate mixture formed by dissolving metallurgical grade alumina in cryolite at high temperature and precipitating alumina crystals out on cooling. The material is then crushed and sized to form a bottom lining aggregate mixture. But we have found that this material is not suitable for the purpose, for in use as the cryolite component melts, the alumina subsides, hence the lining is not dimensionally stable.

EPA No. 132031 describes a cell having a lining based on alumina and containing a layer rich in sodium aluminate which, on penetration of the layer by the electrolyte, dissolves in or reacts with the electrolyte so as to raise the solidus thereof. An example shows a layer of tabular alumina shapes with spaces between the shapes filled with crushed tabular alumina, alphaalumina powder, and sodium aluminate. But sodium aluminate is an irritant and hygroscopic so that its use in cell linings involves the introduction of water, a potentially corrosive species particularly with regard to metal or RHM cathode current collectors. Under cell operating conditions, sodium aluminate reacts with tabular alumina to form sodium beta alumina. The associated volume expansion disrupts the lining.

U.S. Pat. No. 3,607,685 describes a cell having a floor made of a monolithic impervious block of fused alumina or a fused mixture containing 70–80% of calcium fluoride or oxide. Monolithic fused cast linings are not compliant and are liable to crack due to the thermal and mechanical stresses commonly encountered in service; and aluminium may penetrate the cracks.

Fine-grained low density alumina powder is prone to recrystallisation and shrinkage in contact with cell electrolyte, so a layer of such powder is not dimensionally stable.

Metallurgical grade alumina is formed by calcining aluminium trihydroxide at 1100°–1200° C. During heating the trihydroxide undergoes a series of changes in composition and crystalline structure with essentially no change in particle shape. The product, sometimes known as gamma-alumina, is soluble in the cell electrolyte, and is used as the cell feedstock. Continued calcination of gamma-alumina causes further changes in crystal structure to the stable hexagonal form, corundum or alpha-alumina. The crystal structure of gamma-alumina is generally cubic although minor amounts of alpha-alumina may be present. Alpha-alumina is hard and inert and is not significantly soluble in cell electrolyte. The calcination of pressed or disc-agglomerated preforms is used to make a sintered form of alpha-alumnina known as tabular alumina, which is widely available as spheres or other shapes up to about 5 cm diameter and as a granular material formed by crushing the shapes.

It is an object of this invention to provide a cell lining based on alumina that combines the best properties of unbonded refractory linings, namely low cost, ease of installation, self healing of cracks, resistance to metal penetration, and compliance to stress, with the best properties of bonded brick or monolithic linings, namely dimensional stability during operation, little change in thermal properties on penetration by bath, low solution rate in molten electrolyte, and solubility therein below that of metallurgical grade gamma alumina.

The invention provides an aluminium electrolytic reduction cell wherein there is provided a lining to support a cryolite-based electrolyte, the lining including an upper layer, which is penetrated by electrolyte during operation of the cell, which layer consists essentially of alumina, in a form which does not significantly dissolve in the electrolyte, including a substantially close-packed array of alumina shapes, the gaps between the shapes being substantially filled with particulate alumina in one or more fractions having discrete particle size ranges, including a fraction having an average particle diameter not more than 20% of the average diameter of the shapes, the layer having a bulk density of at least 2.0 g/cc.

The lining may advantageously also include a lower layer which may be a low-density powder chosen for its heat insulating properties. There may also be present in the lining one or more intermediate layers of particulate material having a suitable size range to ensure dimensional stability.

The upper layer of the lining preferably consists essentially of sintered tabular alumina or fused alumina aggregate. Tabular alumina is less expensive to install than carbon cell floors, has a cmparable cell life, and can be ground up or cut up for further use at the end of its life.

Other materials are preferably absent from the upper layer or present only in minor proportions. Ground up cryolite from spent cell lining may be present, but at a lower concentration to avoid dimensional instability.

The structure of the upper layer is preferably provided by a close-packed array of shapes, e.g. spheres, of tabular or fused alumina of 5 to 30 mm, for example 10 to 20 mm, diameter. However, the alumina shapes may be either regular (e.g. spherical) or irregular in appearance. The important requirement is that they can pack to produce a rigid skeleton and a high bulk density. Two factors determine the size of the shapes. If the shapes are too large, then large voids may be left between them by shrinkage or movement of intervening material. If the shapes are too small, they may be easily mechanically displaced by the motion of the cell liquids or mechanical prodding. It has been found that an alumina lining containing a skeletal structure of 20 mm diameter alumina spheres is hard and dimensionally stable.

The gaps between the shapes are substantially fileld with particulate alumina in one or more, preferably two or more, fractions having discrete particle size ranges. There is preferably used a coarser fraction having a particle diameter up to 20% e.g. from 3% to 20% of that of the shapes. Preferably there is also used at least one finer fraction having a particle diameter up to 20% e.g. from 3% to 20% of that of the next coarser fraction; and so on. The proportions of these fractions are chosen to maximise the density of the resulting mixture. The density of tabular alumina is about 3.8 g/cc, and the bulk density of the mixture should be at least 2.0 preferably about 2.8, g/cc. The effect of this is to keep the void volume of the layer to a minimum. This is desirable because the layer is inevitably impregnated by electrolyte during operation of the cell, and it is important that any alteration in the thermal properties of the layer resulting from such impregnation be as small as possible. Once the size of the particulate fractions have been chosen, a skilled worker is readily able to select proportions so as to maximise the bulk density of the mixture, as shown in Example 1.

The preferred method of building this upper layer into the cell is to pre-mix the shapes with the particulate alumina fractions and dump the mixture into the shell on top of lower layers provided for heat insulation. Then the mixture is compacted by vibration from above using a flat plate or by vibrating the shell. The discrete size ranges of the shapes and particle fractions and the properties of those fractions are chosen to avoid segregation on vibration or mixing. If segregation were not avoided in this way, then the layer would have to be built up by the laborious process of alternately introducing alumina shapes into the shell and sifting particulate material around them.

A properly built upper layer of tabular alumina is virtually impossible to dig out with a spade, although it is formed of loose particles, and has the following advantages:

- Minimum water content, compared to layers containing other materials such as gamma alumina or sodium aluminate.
- Minimum reactivity and rate of dissolution in cell electrolyte.
- Minimum porosity, i.e. maximum bulk density, and hence minimum change in properties during start-up and operation.
- Minimum recrystallisation and dimensional changes on exposure to cell electrolyte.
- No contamination of product metal or electrolyte by contact with lining material.
- No substantial segregation of size fractions on mixing or vibration.
- Easy and inexpensive to install compared to a carbonaceous lining.
- Long cell life.

The top portion of the spent lining has been impregnated with electrolyte and is a solid that must be cut or chipped out of the shell. The spent material can be put to several uses:

(a) It can be ground up and used as feedstock for another cell. However, this might require modified feeding equipment, and is not preferred owing to the low solution rate of this material.

(b) The ground material, which has a high angle of repose, can be used to provide a superior anode and crust coverage, optionally together with metallurgical grade alumina. This would overcome some of the problems of maintaining anode coverage which arise as a result of the low angle of repose of metallurgical grade alumina when used alone.

(c) The ground material can be used as the intermediate and fine fraction of the tabular alumina lining aggregate.

(d) Tubes cut from the spent lining can be placed round the high temperature refractory sections of cathode current collectors for protection of the latter.

The upper layer should extend from the floor of the cell to a point beyond which further penetration of molten electrolyte will not take place, i.e. generally down to the 700°-800° C. isotherm. In the region where no liquid penetration is expected, different properties are required of the lining. In particular, heat insulation is a dominant requirement in the lower layer of the lining, and lower density materials having substantial void volumes, are preferred. Also, since the potlining contains fluoride-containing gases, lining material should preferably be inert to fluirode and other corrosive gas species. Preferred is metallurgical grade alumina mineralised or calcined substantially to 100% alpha on account of its inertness and low water content. Powdered materials are preferably used and vibrated down to avoid settling or movement in use.

Thus a preferred cell lining according to the invention comprises two layers:

- A dense substantially impervious upper layer consisting essentially of close-packed tabular alumina shapes with the interstices filled with particulate alpha-alumina in one or more discrete size ranges, extending from the cell to the 700°-800° C. isotherm.
- A thermally insulating lower layer composed of vibrated alumina powder (perferably alpha alumina) extending from the upper layer to the shell.

However, low bulk density alpha-alumina is to some prone to recrystallisation and shrinkage upon exposure to high temperature and fluoride vapours or liquids. It may therefore be necessary to include in the lining one or more extra layers, intermediate the upper and lower layers, comprising dense sintered or fused alumina shapes mixed with powder so that the shapes prevent macroscopic dimensional changes even if recrystallisation and shrinkage of powder between the shapes takes place. As in the upper layer, the shapes preferably have a diameter in the range 5-30 mm. Here however, unlike the upper layer, a low bulk density with maximum void volume is desired. So the shapes may be solid spheres but are preferably high void fraction shapes such as hollow spheres, cylinders, rings, saddles or honeycomb-type structures. Hollow insulating alumina bubbles are especially suitable for this layer. Also it is not essential that the powder fill the interstices between the shapes. The shapes may suitably constitute from 30% to 100% by weight of the mixture. These intermediate layers, if present, may extend down to the 450°-650° C. isotherm.

The lining considered up to now has mainly been the cell floor and insulation below the floor. The sidewalls of the cell may be carbon as in conventional practice. Alternatively, provided that they are protected by a freeze from direct contact with the molten cell electrolyte, the sidewalls can also be made of alumina. Preferably fuse-cast or high-density sintered alumina blocks or bricks or calcium aluminate bonded alumina castable formulations are used. These blocks have thermal conductivities similar to carbonaceous blocks. An advantage of alumina sidewall blocks, giving an all alumina cell, lies in easier recovery and cleaner cell operation.

BRIEF DESCRIPTION OF THE DRAWING

The accompanying drawing is a section through part of an aluminium electrolytic reduction cell according to the invention.

DETAILED DESCRIPTION OF THE DRAWING

Referring to the drawing, an anode 10 dips into a layer 12 of cell electrolyte which overlies a layer 14 of molten product metal. The molten metal lies on the cell lining which comprises an upper layer 16, an intermediate layer 18 and a lower layer 20, whose constitutions and structures are as herein described. At the bottom of a depression 22 in the cell lining there is positioned a cathode current collector comprising a high temperature section 24 of electrically conducting refractory material and a low temperature section 26 of aluminium metal.

The following Examples illustrate the invention.

EXAMPLE 1

A 16 kA experimental cell was built with a lining consisting of two layers. The lower thermally insulating layer was of alpha-alumina powder vibrated to a density of 1.1 $g.cm^{-3}$, and extended from the shell up to the 700° C. isotherm, i.e. to a thickness of 500 mm. The upper layer was 350 mm thick and comprised of tabular alumina in three size fractions as follows:

Coarse 20 mm diameter tabular alumina balls.
Medium 0.6-1.2 mm diameter crushed tabular alumina.
Fine dust collector alpha-alumina fines of particle size below 0.08 mm.

The weight percent of each fraction was optimised using a ternary density diagram in which each corner represented 100% of one fraction. The bulk density and segregation characteristics were plotted as a function of composition. Compositions within the following ranges were investigated:

Coarse 40-60 wt. %
Medium 10-30 wt. %
Fine 20-40 wt. %

The optimum composition is that at which maximum density can be obtained with minimum segregation. The proportions chosen were coarse: medium: fine, 55:15:30 by weight. This gave a maximum packing density of about 2.8 g/cc and minimum segregation. The alumina fractions were mixed in a drum mixer, then poured into the cell cavity and densified by vibration using a top plate vibrator. This is a low cost operation with low manpower requirements.

The cell was operated for a period of one month at 980° C. and a $NaF/AlF_3$ ratio of 1.25. During operation lining temperature profiles stabilized within one week of start up and showed no thermal performance degradation during the rest of the operation. The cryolite penetration of the top layer of the lining did not sufficiently change the lining thermal conductivity to degrade the lining performance. The top surface of the lining remained flat during the operation, and was hard even when prodded with a steel bar. On postmortem, the upper layer of lining was found to be dimensionally stable despite impregnation by cell electrolyte to a depth of approximatley 300 mm. There was no chemical reaction with and no significant dissolution in the electrolyte. The bottom layers of alpha alumina powder remained unbonded and could be re-used in cell linings with no additional preparation.

EXAMPLE 2

This was performed as Example 1, except that the lower (insulating) layer of the cell lining comprised a mixture of alpha-alumina powder and dry sodium aluminate powder. And the upper part of this layer contained 2 cm diameter tabular alumina spheres, thus constituting an intermediate layer.

On postmortem, after operation of the cell for one month, it was found that just below the level of the deepest fluoride liquid penetration there was a layer in which recrystallisation and shrinkage of the alumina powder had taken place, forming small voids between the alumina spheres, However, the alumina spheres had remained intact and had prevented macroscopic dimensional changes in this layer.

We claim:

1. An aluminium electrolytic reduction cell wherein there is provided a lining to support the liquid cell contents, the lining including an upper layer, which is penetrated by electrolyte during operation of the cell, which layer consists essentially of unbonded alumina, including a substantially close-packed array of alumina shapes, the gaps between the shapes being substantially filled with particulate alumina in one or more fractions having discrete particle size ranges, including a fraction having an average particle diameter not more than 20% of the average diameter of the shapes, the layer having a bulk density of at least 2.0 g/cc.

2. A cell as claimed in claim 1, wherein the upper layer of the lining consists essentially of sintered tabular or fused alpha alumina.

3. A cell as claimed in claim 1, wherein the alumina shapes are of 5 to 30 mm diameter.

4. A cell as claimed in claim 1, wherein the gaps between the shapes are substantially filled with particulate alumina in two fractions having discrete particle size ranges, the coarser fraction having an average particle diameter of 3% to 20% of the average diameter of the shapes, and the finer fraction having an average particle diameter of 3% to 20% of that of the coarser fraction.

5. A cell as claimed in claim 4, wherein the proportions of the fractions are such as to maximise the bulk density of the mixture.

6. A cell as claimed in claim 1, wherein the lining also includes a thermally insulating lower layer.

7. A cell as claimed in claim 6, wherein the lower layer is composed of alpha-alumina powder.

8. A cell as claimed in claim 6, wherein the lining also includes a thermally insulating layer intermediate the upper and lower layers said intermediate layer having a structure provided by alumina shapes in admixture with low density alumina powder.

9. A cell as claimed in claim 8, wherein the shapes are of sintered tabular or fused alpha alumina of 5 to 30 mm diameter and the powder is alpha-alumina.

10. A cell as claimed in claim 1, wherein the cell is provided with side walls to contain the liquid cell contents, which side walls are also of alumina.

* * * * *